US006802783B1

(12) United States Patent
Tseng

(10) Patent No.: US 6,802,783 B1
(45) Date of Patent: Oct. 12, 2004

(54) SWING INCLUDING A SEAT UNIT WITH A TILTABLE BACKREST AND A FOOTREST MOVABLE RELATIVE TO A SEAT FRAME

(75) Inventor: Chuen-Jong Tseng, Chiayi Hsien (TW)

(73) Assignee: Taiwan Shin Yeh Enterprise Co., Ltd., Chiayi Hsien (TW)

( * ) Notice: Subject to any disclaimer, the term of this patent is extended or adjusted under 35 U.S.C. 154(b) by 0 days.

(21) Appl. No.: 10/603,013

(22) Filed: Jun. 24, 2003

(51) Int. Cl.[7] ..... A63G 9/02
(52) U.S. Cl. ..... 472/118; 472/125; 297/216.16
(58) Field of Search ..... 472/118, 119, 472/120, 121, 122, 123, 124, 125; 297/273, 216.18, 216.16

(56) References Cited

U.S. PATENT DOCUMENTS 1,137,325 A * 4/1915 Jacobsen ..... 297/116
5,058,951 A * 10/1991 Thiel ..... 297/278
5,667,273 A * 9/1997 Noll ..... 297/171
6,348,005 B1 * 2/2002 Tseng ..... 472/118
6,695,401 B1 * 2/2004 Noll ..... 297/281
6,715,827 B1 * 4/2004 Chen ..... 297/148

* cited by examiner

*Primary Examiner*—Kien Nguyen
(74) *Attorney, Agent, or Firm*—Ladas & Parry

(57) ABSTRACT

A swing includes a seat unit having a seat frame disposed between two armrest frames, and a backrest frame pivoted to a rear end of the seat frame through a first pivot pin and to one of the armrest frames about a second pivot pin above the first pivot pin, a footrest frame pivoted to a front end of the seat frame through a third pivot pin, and an inclination adjusting rod pivotally connecting the footrest frame and a lower end of the backrest frame. A sliding member is fixed to the seat frame, and is slidably mounted on a guiding member that is secured to said one of the armrest frames. A fastener releasably fastens the sliding member to the guiding member to prevent sliding movement of the sliding member and the seat frame relative to the guiding member.

2 Claims, 6 Drawing Sheets

SWING INCLUDING A SEAT UNIT WITH A TILTABLE BACKREST AND A FOOTREST MOVABLE RELATIVE TO A SEAT FRAME

BACKGROUND OF THE INVENTION

1. Field of the Invention

The present invention relates to a swing, more particularly to a swing having a seat unit with a backrest and a footrest movable relative to a seat frame.

2. Description of the Related Art

A conventional swing includes a seat unit and an upright support frame unit. The support frame unit has left and right support frames and a transverse rod fixed to top ends of the frames. The seat unit includes left and right armrest frames swingably connected to the transverse rod through suspending members, such as cords or chains. A seat frame is disposed between the left and right armrest frames, and is fixed to a backrest frame.

SUMMARY OF THE INVENTION

The object of this invention is to provide a swing that includes a seat unit having a tiltable backrest and a footrest movable relative to a seat frame.

According to the present invention, a swing includes a seat unit and a support unit. The seat unit includes: front and rear connecting rods extending in a longitudinal direction, two spaced apart armrest frames extending in a transverse direction relative to the longitudinal direction, one of the armrest frames having an upper armrest part, and front and rear parts extending downwardly and respectively from two opposite ends of the upper armrest part and connected respectively to the front and rear connecting rods; first, second, third and fourth pivot pins; a seat frame disposed above the front connecting rod between the armrest frames and including a side part adjacent to said one of the armrest frames and having opposite front and rear ends; a backrest frame disposed rearwardly of the seat frame, extending in a direction transverse to the longitudinal and transverse directions, and including a side part having a lower end disposed below the seat frame, an upper end opposite to the lower end, and an intermediate portion pivoted to the rear end of the side part of the seat frame through the first pivot pin and to the rear part of said one of the armrest frames through the second pivot pin, which is disposed at an elevation above the first pivot pin and which is parallel to the first pivot pin, the backrest frame being rotatable about the first and second pivot pins between a normal position and a tilted position; a footrest frame disposed frontwardly of the seat frame and including a side part that has a front end and a rear end opposite to the front end of the footrest frame and pivoted to the front end of the side part of the seat frame through the third pivot pin, which is parallel to the first pivot pin, the footrest frame extending downwardly from the seat frame when the backrest frame is disposed at the normal position; an inclination-adjusting rod disposed below the seat frame, extending in the transverse direction, having a rear end pivoted to the rear end of the side part of the backrest frame through the fourth pivot pin, which is parallel to and which is disposed at an elevation below the first pivot pin, and a front end opposite to the rear end of the inclination-adjusting rod and pivoted to the side part of the footrest frame at a position between the front and rear ends of the side part of the footrest frame such that rearward rotation of the backrest frame about the first and second pivot pins from the normal position to the tilted position results in a forward movement of the inclination-adjusting rod, which, in turn, results in upward rotation of the footrest frame about the third pivot pin; and a position adjusting unit including a guiding member and a sliding member. The guiding member is secured to said one of the armrest frames and defines a rail extending in the transverse direction. The sliding member is connected securely to the side part of the seat frame and is mounted slidably on the rail so as to permit co-sliding movement of the sliding member and the seat frame along the rail. The position adjusting unit further includes a fastener for releasably fastening the sliding member to the rail so as to prevent sliding movement of the sliding member and the seat frame. The support unit includes an upright support frame having opposite top and bottom ends, and left and right suspending members respectively having upper ends connected swingably to the top end of the support frame, and lower ends connected swingably and respectively to the seat unit.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
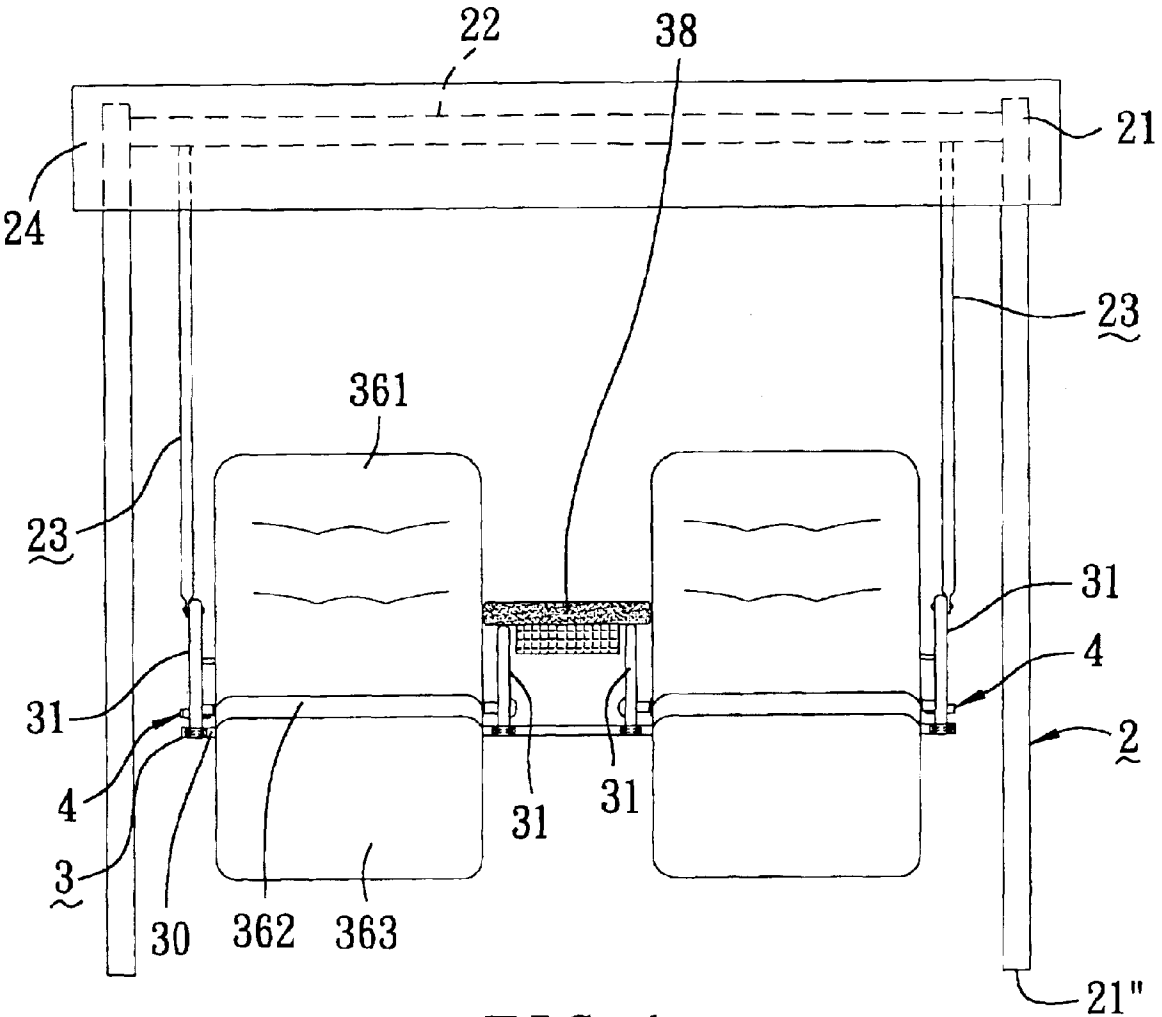
FIG. 1 is a schematic front view of the preferred embodiment of a swing according to the present invention.
Figure 2:
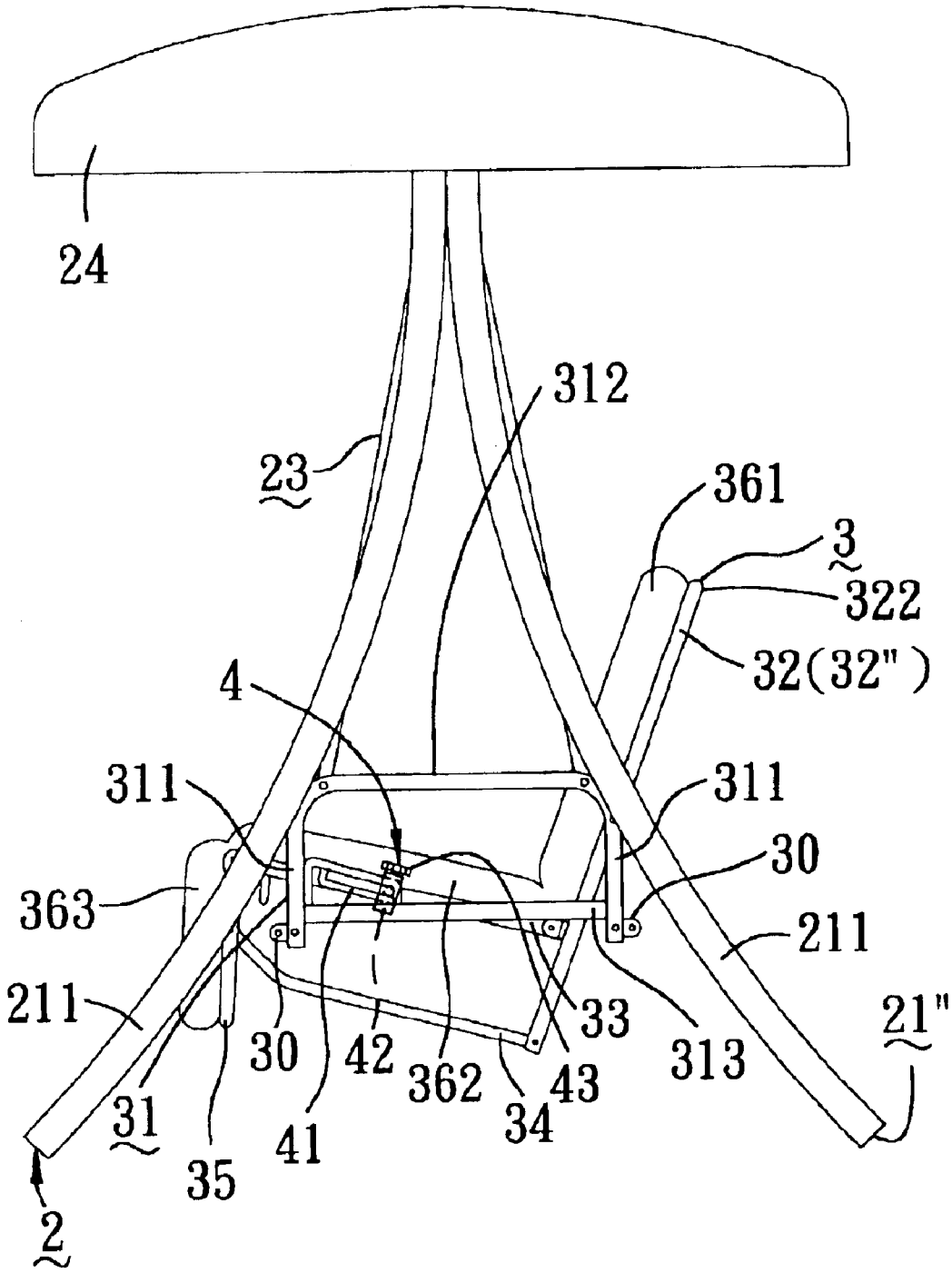
FIG. 2 is a schematic side view of the preferred embodiment.
Figure 3:
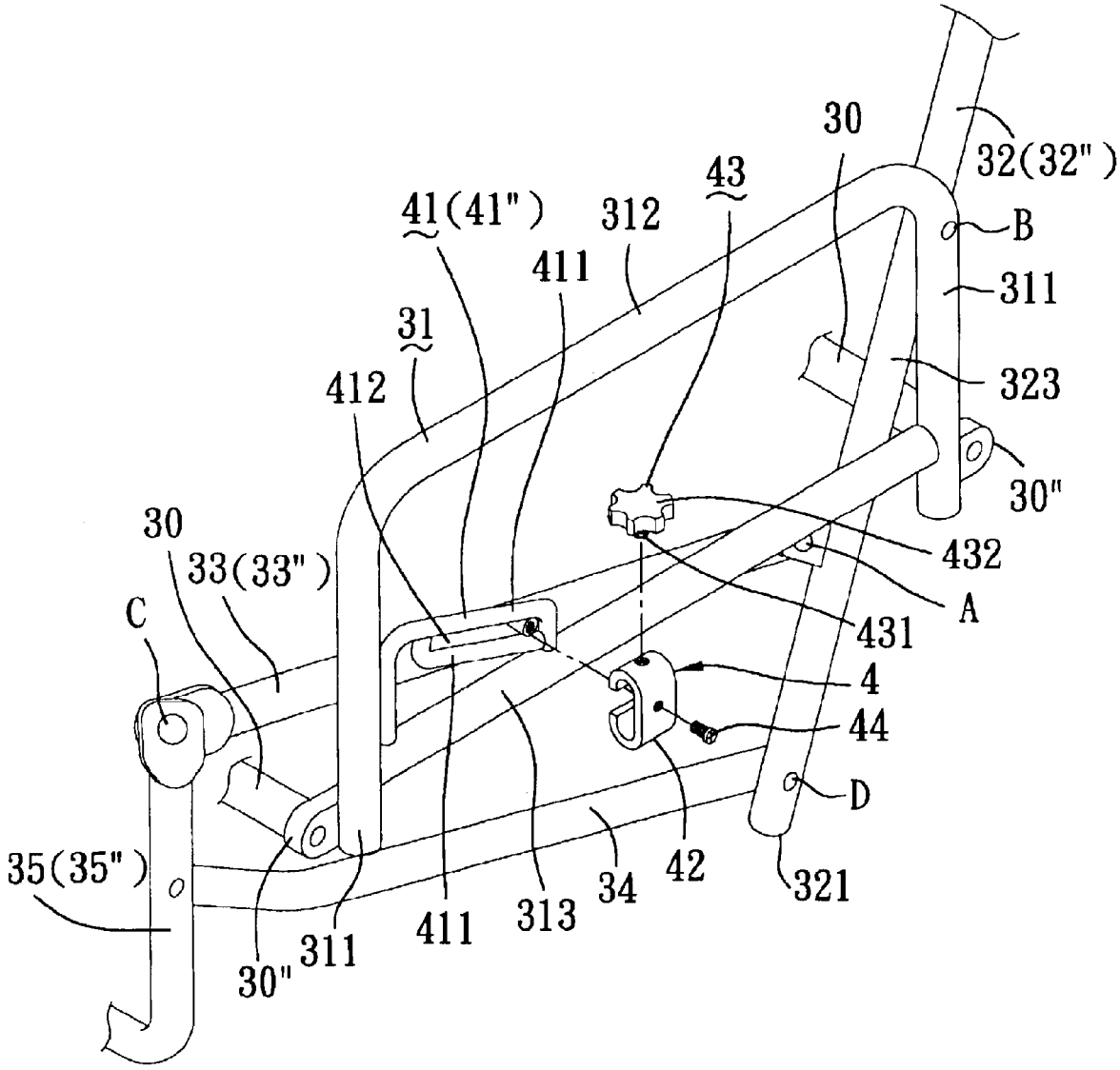
FIG. 3 is a fragmentary perspective side view of the preferred embodiment, illustrating interconnection among a seat frame, a backrest frame, a footrest frame and an inclination-adjusting rod.

Referring to FIGS. 1, 2 and 3, the preferred embodiment of a swing according to the present invention is shown to include a pair of seat units 3 and a support unit.

As illustrated, each of the seat units 3 includes front and rear connecting rods 30, two spaced apart inverted U-shaped armrest frames 31, a seat frame 33, a backrest frame 32, a footrest frame 35, two inclination-adjusting rods 34 (only one is shown in the drawings), and a position adjusting unit 4. The front and rear connecting rods 30 extend in a longitudinal direction. Each of the armrest frames 31 extends in a transverse direction relative to the longitudinal direction, has an upper armrest part 312, and front and rear parts 311 extending downwardly and respectively from two opposite ends of the upper armrest part 312 and connected respectively to the front and rear connecting rods 30 through four lugs 30" (see FIG. 3), which are respectively fixed to lower ends of the front and rear parts 311 of the armrest frames 31. Each of the armrest frames 31 further has a lower reinforcing part 313 interconnecting the front and rear parts 311 at positions adjacent to the lower ends thereof so as to enhance rigidity of the respective armrest frame 31.

Figure 4:
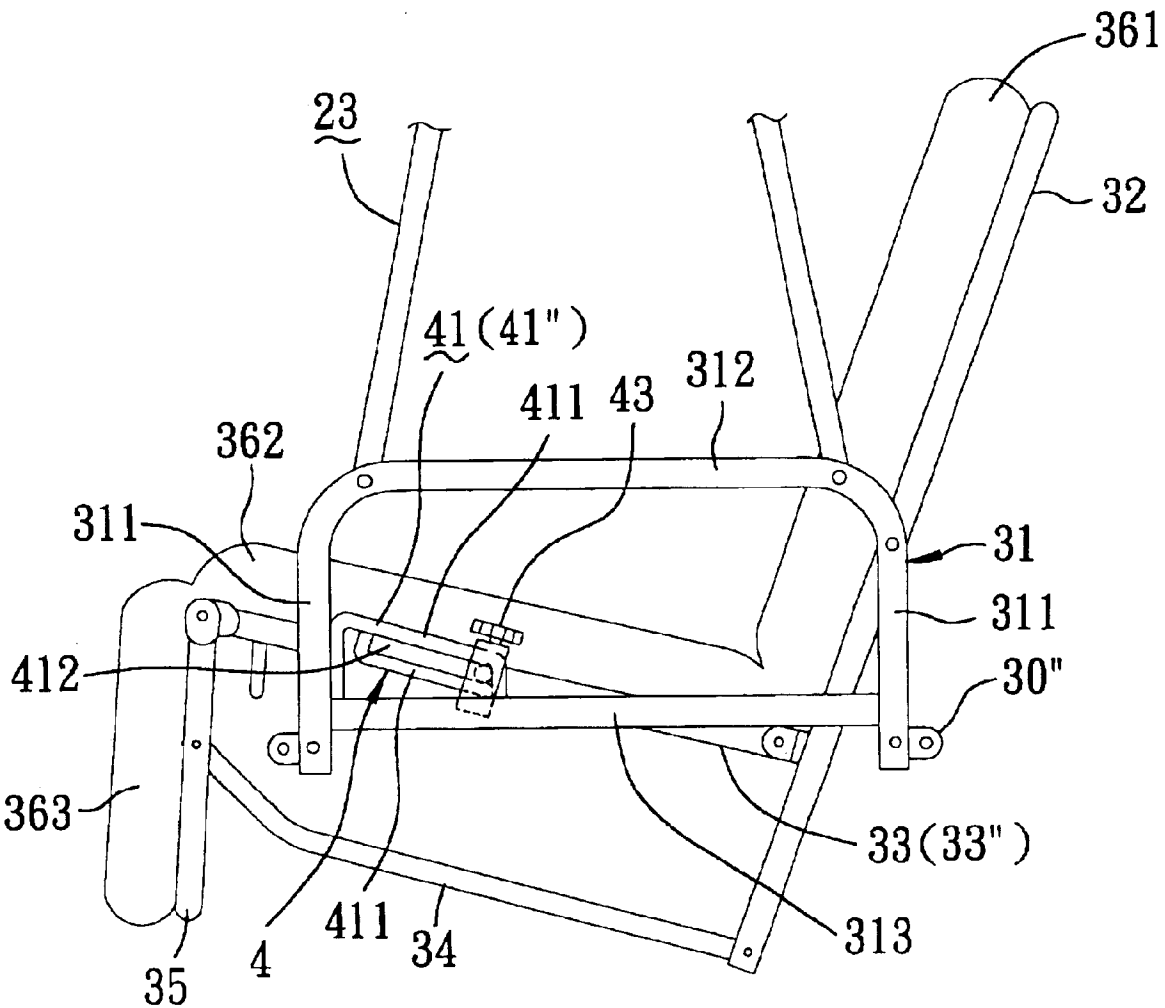
FIG. 4 is a fragmentary side view of the preferred embodiment, illustrating how the backrest frame is disposed at a normal position relative to the seat frame by a position adjusting unit.
Figure 5:
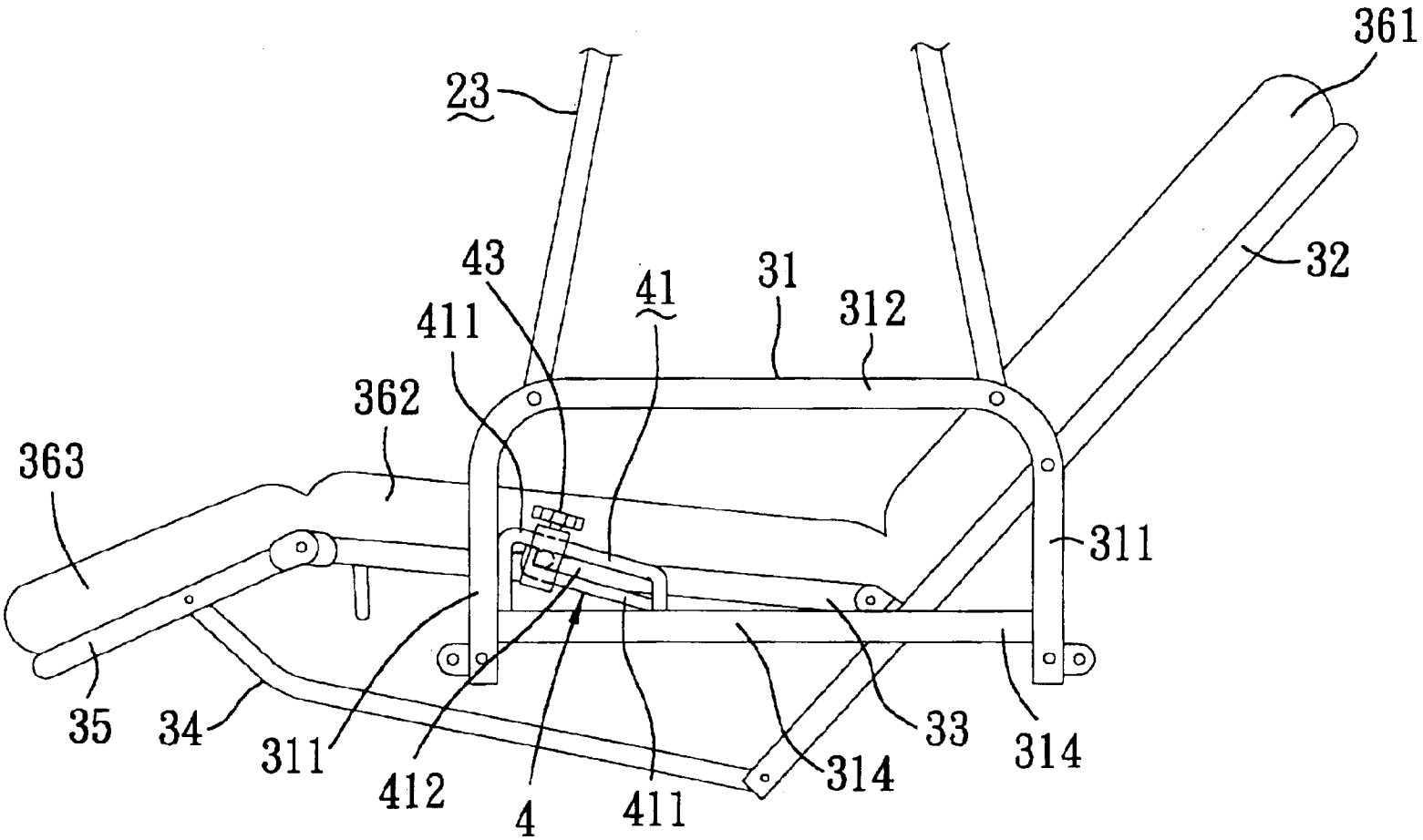
FIG. 5 is a fragmentary side view of the preferred embodiment, illustrating how the backrest frame is disposed at a tilted position relative to the seat frame by the position adjusting unit.

The seat frame 33 is disposed slidably above the front connecting rod 30 between the armrest frames 31, and includes right and left side parts 33" that are disposed adjacent to the armrest frames 31, respectively. Each of the right and left side parts 33" of the seat frame 33 has opposite front and rear ends. The backrest frame 32 is disposed rearwardly of the seat frame 33, extends in a direction transverse to the longitudinal and transverse directions, and includes right and left side parts 32", each of which has a lower end 321 disposed below the seat frame 33, an upper end 322 opposite to the lower end 321, and an intermediate portion 323 pivoted to the rear end of a respective one of the right and left side parts 33" of the seat frame 33 through a first pivot pin (A) and to the rear part 311 of a respective one of the armrest frames 31 through a second pivot pin (B), which is disposed at an elevation above the first pivot pin (A) and which is parallel to the first pivot pin (A). Under this condition, the backrest frame 32 is rotatable about the first and second pivot pins (A,B) between a normal position as shown in FIG. 4 and a tilted position as shown in FIG. 5.

The footrest frame 35 is disposed frontwardly of the seat frame 33, and includes right and left side parts 35", each of which has a front end and a rear end opposite to the front end of a respective one of the right and left side parts 35" and pivoted to the front end of a respective one of the right and left side parts 33" of the seat frame 33 through a third pivot pin (C), which is parallel to the first pivot pin (A). When the backrest frame 32 is disposed at the normal position, the footrest frame 35 extends downwardly from the seat frame 33 (see FIG. 4).

The inclination-adjusting rods 34 are disposed below the seat frame 33, and extend in the transverse direction. Each of the inclination-adjusting rods 34 has a rear end pivoted to the lower end 321 of a respective one of the right and left side parts 32" of the backrest frame 32 through a fourth pivot pin (D), which is parallel to and which is disposed at an elevation below the first pivot pin (A), and a front end opposite to the rear end of the respective inclination-adjusting rod 34. The front end of each of the inclination-adjusting rods 34 is pivoted to a respective one of the right and left side parts 35" of the footrest frame 35 at a position between the front and rear ends of said one of the right and left side parts 35" of the footrest frame 35 such that rearward rotation of the backrest frame 32 about the first and second pivot pins (A,B) from the normal position to the tilted position results in a forward movement of the inclination-adjusting rods 34, which, in turn, results in upward rotation of the footrest frame 35 about the third pivot pins (C) (see FIG. 5).

The position adjusting unit 4 includes a guiding member 41, a sliding member 42, and a fastener 43. The guiding member 41 is secured to the front part 311 of one of the armrest frames 31, and defines a rail 41" extending in the transverse direction. The sliding member 42 is connected securely to the side part 33" of the seat frame 33 which is adjacent to said one of the armrest frames 31, and is mounted slidably on the rail 41" so as to permit co-sliding movement of the sliding member 42 and the seat frame 33 along the rail 41". The fastener 43 releasably fastens the sliding member 42 to the rail 41" so as to prevent sliding movement of the sliding member 42 and the seat frame 33. The fastener 43 includes a threaded shank 431 and a turning knob 432 fixed to the threaded shank 431 to facilitate turning of the threaded shank 431.

Figure 6:
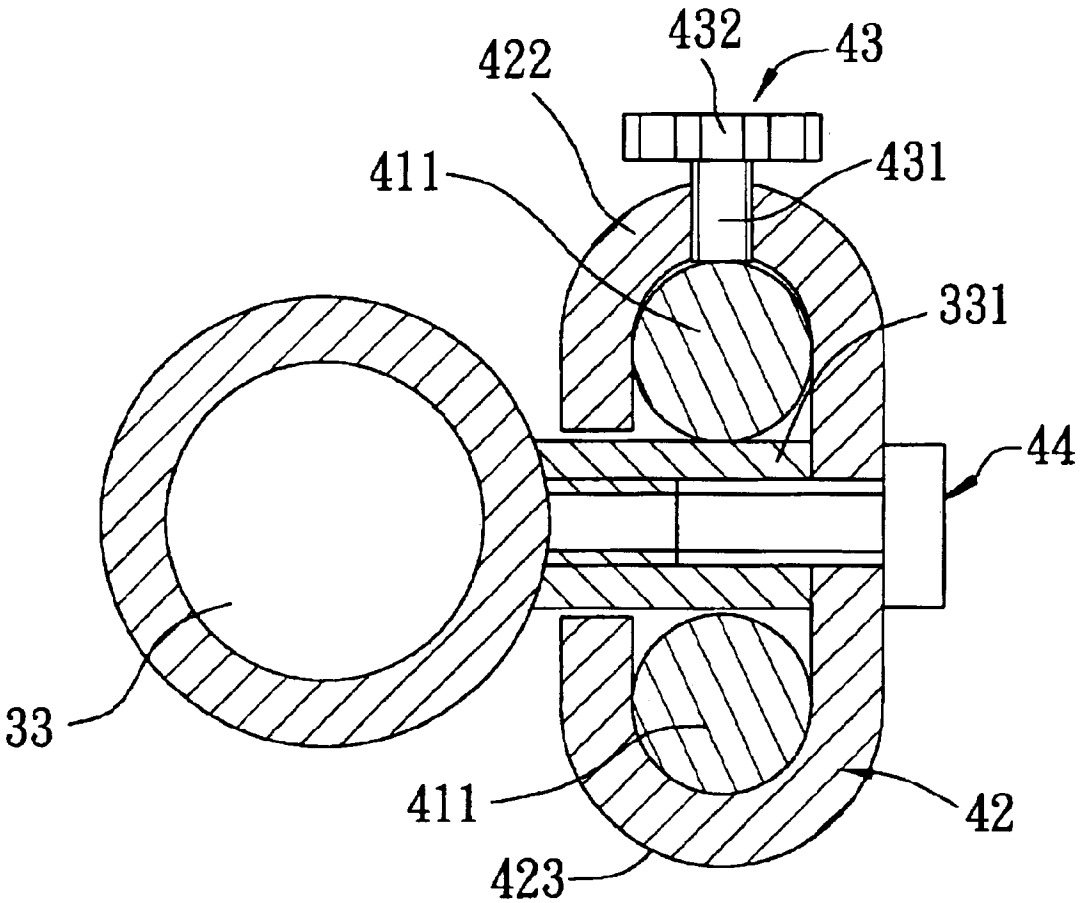
FIG. 6 is a sectional view of the preferred embodiment in part, illustrating how the seat frame is fastened releasably by the position adjusting unit.

In the preferred embodiment, the rail 41" includes parallel upper and lower rods 411 extending in the transverse direction and cooperatively defining an elongate gap 412 therebetween. The side part 33" of the seat frame 33 which is adjacent to said one of the armrest frames 31 is formed with a protrusion 331 (see FIG. 6) that protrudes outwardly therefrom and that extends through the elongated gap 412 defined by the upper and lower rods 411. The protrusion 331 is formed with an inner thread. The sliding member 42 is C-shaped, is disposed at one side of the upper and lower rods 411 opposite to the seat frame 33, and defines an inner space to permit extension of the protrusion 331 thereinto. The sliding member 42 has curved upper and lower hook ends 422,423 (see FIG. 6) that are mounted slidably and respectively to the upper and lower rods 411. A fastener bolt 44 extends through the sliding member 42 and engages the inner thread in the protrusion 331 so as to press the sliding member 42 against the protrusion 331, thereby securing the sliding member 42 on the protrusion 331 of the seat frame 33. The threaded shank 431 of the fastener 43 threadedly engages and extends through the curved upper hook end 422 of the sliding member 42, and is adjustable for moving toward the upper rod 411 so as to abut against the upper rod 411 upon tightening.

The support unit includes an upright support frame 2 and left and right suspending members 23. The upright support frame 2 includes left and right upright supports 211 each having opposite top and bottom ends 21,21", and a transverse rod 22 fixed to the top ends 21 of the left and right upright supports 211. The left and right suspending members 23 have upper ends connected swingably to the transverse rod 22, and lower ends connected swingably and respectively to the upper armrest parts 312 of the outer ones of the armrest frames 31 of the seat units 3. Preferably, a canopy 24 is mounted on the top ends 21 of the upright supports 211 for shading purposes.

Preferably, a horizontal support plate 38 is disposed between and cooperates with the inner ones of the armrest frames 31 of the seat units 3 to serve as a table.

In order to provide comfort to the seated person, a backrest cushion 361, a seat cushion 362 and a footrest cushion 363 can be respectively fixed on the backrest frame 32, the seat frame 33, and the footrest frame 35.

When it is desired to adjust the position of the backrest frame 32 and the footrest frame 35 of one of the seat units 3, the threaded shank 431 of the fastener 43 is loosened so as to disengage from the upper rod 411. Under this condition, the backrest frame 32 can be pushed rearward by body weight of the seated person so as to rotate the backrest frame 32 relative to the armrest frames 31 about the second pivot pin (B) and relative to the seat frame 33 about the first pivot pin (A), which, in turn, results in upward rotation of the footrest frame 35 about the third pivot pin (C).

With this invention thus explained, it is apparent that numerous modifications and variations can be made without departing from the scope and spirit of this invention. It is therefore intended that the invention be limited only as indicated in the appended claims.

I claim:

1. A swing comprising:

a seat unit including front and rear connecting rods extending in a longitudinal direction, two spaced apart armrest frames extending in a transverse direction relative to said longitudinal direction, one of said armrest frames having an upper armrest part, and front and rear parts extending downwardly and respectively from two opposite ends of said upper armrest part and connected respectively to said front and rear connecting rods, first, second, third and fourth pivot pins, a seat frame disposed above said front connecting rod between said armrest frames, and including a side part adjacent to said one of said armrest frames and having opposite front and rear ends, a backrest frame disposed rearwardly of said seat frame, extending in a direction transverse to said longitudinal and transverse directions, and including a side part having a lower end disposed below said seat frame, an upper end opposite to said lower end, and an intermediate portion pivoted to said rear end of said side part of said seat frame through said first pivot pin and to said rear part of said one of said armrest frames through said second pivot pin, which is disposed at an elevation above said first pivot pin and which is parallel to said first pivot pin, said backrest frame being rotatable about said first and second pivot pins between a normal position and a tilted position, a footrest frame disposed frontwardly of said seat frame, and including a side part that has a front end and a rear end opposite to said front end of said footrest frame and pivoted to said front end of said side part of said seat frame through said third pivot pin, which is parallel to said first pivot pin, said footrest frame extending downwardly from said seat frame when said backrest frame is disposed at said normal position, an inclination-adjusting rod disposed below said seat frame, extending in said transverse direction, having a rear end pivoted to said lower end of said side part of said backrest frame through said fourth pivot pin, which is parallel to and which is disposed at an elevation below said first pivot pin, and a front end opposite to said rear end of said inclination-adjusting rod and pivoted to said side part of said footrest frame at a position between said front and rear ends of said side part of said footrest frame such that rearward rotation of said backrest frame about said first and second pivot pins from said normal position to said tilted position results in a forward movement of said inclination-adjusting rod, which, in turn, results in upward rotation of said footrest frame about said third pivot pin, and a position adjusting unit including a guiding member and a sliding member, said guiding member being secured to said one of said armrest frames and defining a rail extending in said transverse direction, said sliding member being connected securely to said side part of said seat frame and being mounted slidably on said rail so as to permit co-sliding movement of said sliding member and said seat frame along said rail, said position adjusting unit further including a fastener for releasably fastening said sliding member to said rail so as to prevent sliding movement of said sliding member and said seat frame; and a support unit including an upright support frame having opposite top and bottom ends, and left and right suspending members having upper ends connected swingably to said top end of said support frame, and lower ends connected swingably and respectively to said seat unit.

2. The swing as defined in claim 1, wherein said rail includes parallel upper and lower rods extending in said transverse direction and cooperatively defining an elongate gap therebetween, said side part of said seat frame being formed with a protrusion that protrudes outwardly therefrom, that extends through said elongated gap, and that is formed with an inner thread, said sliding member being C-shaped, being disposed at one side of said upper and lower rods opposite to said seat frame, defining an inner space to permit extension of said protrusion therein, and having curved upper and lower hook ends that are mounted slidably and respectively on said upper and lower rods, said position adjusting unit further including a fastener bolt extending through said sliding member and engaging said inner thread so as to press said sliding member against said protrusion, thereby securing said sliding member on said protrusion of said seat frame, said fastener threadedly engaging and extending through said curved upper hook end of said sliding member and being adjustable for moving toward said upper rod so as to abut against said upper rod upon tightening.

* * * * *